US009890942B2

(12) United States Patent
Lin et al.

(10) Patent No.: US 9,890,942 B2
(45) Date of Patent: Feb. 13, 2018

(54) LAMP WITH A HEAT SINK

(71) Applicant: PHILIPS LIGHTING HOLDING B.V., Eindhoven (NL)

(72) Inventors: Lihua Lin, Shanghai (CN); Aldo Tralli, Eindhoven (NL); Theodoor Cornelis Treurniet, Best (NL); Aldegonda Lucia Weijers, Eindhoven (NL); Martijn Evert Paul Jansen, Eindhoven (NL); Sait Izmit, Utrecht (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 122 days.

(21) Appl. No.: 14/428,648

(22) PCT Filed: Sep. 17, 2013

(86) PCT No.: PCT/IB2013/058596
§ 371 (c)(1),
(2) Date: Mar. 17, 2015

(87) PCT Pub. No.: WO2014/045188
PCT Pub. Date: Mar. 27, 2014

(65) Prior Publication Data

US 2015/0233568 A1 Aug. 20, 2015

(30) Foreign Application Priority Data

Sep. 18, 2012 (WO) ..... PCT/CN2012/081550

(51) Int. Cl.
*F21V 23/00* (2015.01)
*F21V 29/74* (2015.01)
*F21Y 101/02* (2006.01)

(52) U.S. Cl.
CPC ..... *F21V 29/74* (2015.01); *F21V 23/005* (2013.01); *F21Y 2101/02* (2013.01)

(58) Field of Classification Search
CPC ..... F21V 29/713
See application file for complete search history.

(56) References Cited

U.S. PATENT DOCUMENTS 7,997,763 B2 8/2011 Giardina et al.
8,018,136 B2 9/2011 Gingrich, III et al.
(Continued)

FOREIGN PATENT DOCUMENTS

DE 202008006327 U1 7/2008
EP 2163808 A1 3/2010
(Continued)

OTHER PUBLICATIONS

Invin Engineering LED Heatsink http://www.ivineng.com/index.php?_m=mod_product&_a=prdlist&p=7.
(Continued)

*Primary Examiner* — Andrew Coughlin
*Assistant Examiner* — Eric T Eide

(57) ABSTRACT

A lamp comprising a driver assembly, the driver assembly including a driver board with driver electronics, at least one point light source and a heat sink, the heat sink including a top side and a bottom side, a central space extending from the bottom side to the top side and adapted for receiving the driver board of the driver assembly, a zone provided at the top side and adapted for receiving the at least one point light source, wherein a plurality of fins adapted for dissipating heat are extending on opposite sides of the central space, and an extension of the central space in at least one radial direction of the heat sink is larger than an extension of the zone in the radial direction of the heat sink such that the
(Continued)

central space is provided with at least one section arranged offset from and radially adjacent to the zone.

13 Claims, 7 Drawing Sheets

(56) References Cited

U.S. PATENT DOCUMENTS

| | | | | |
|---|---|---|---|---|
| 8,157,422 | B2 | 4/2012 | Paik et al. | |
| 8,764,251 | B2 * | 7/2014 | Lien | F21V 29/2231 313/46 |
| 8,801,233 | B2 * | 8/2014 | Lu | F21V 5/002 362/249.02 |
| 8,979,337 | B2 * | 3/2015 | Creusen | F21K 9/00 362/265 |
| 2009/0141508 | A1 * | 6/2009 | Peng | F21V 23/02 362/373 |
| 2009/0218923 | A1 | 9/2009 | Gingrich, III | |
| 2009/0237933 | A1 | 9/2009 | Liu | |
| 2011/0018418 | A1 | 1/2011 | Yoo | |
| 2011/0181167 | A1 | 7/2011 | Cho et al. | |
| 2012/0051069 | A1 | 3/2012 | Lim | |
| 2012/0140462 | A1 * | 6/2012 | Pickard | G02B 17/086 362/231 |
| 2012/0230034 | A1 * | 9/2012 | Boomgaarden | F21V 3/02 362/294 |
| 2012/0268936 | A1 * | 10/2012 | Pickard | F21K 9/90 362/249.02 |
| 2012/0268954 | A1 * | 10/2012 | Yamamoto | F21V 23/006 362/382 |
| 2014/0055997 | A1 * | 2/2014 | Achammer | F21K 9/00 362/235 |

FOREIGN PATENT DOCUMENTS

| | | | |
|---|---|---|---|
| JP | 2006244725 | A | 9/2006 |
| JP | 2008293753 | A | 12/2008 |
| JP | 2010062005 | A | 3/2010 |
| JP | 2011513917 | A | 4/2011 |
| JP | 2012119314 | A | 6/2012 |
| KR | 20100033142 | | 3/2010 |
| WO | WO2011152038 | A1 | 12/2011 |

OTHER PUBLICATIONS

USHIOP_SYNERGY 4 WATT 3100K 12V LED MR16 Lamp, Narrow Flood http://www.goodmart.com/products/.

LED Light Manufacturer http://sielement.com/ledlightsblog/archives/104.

* cited by examiner

LAMP WITH A HEAT SINK

CROSS-REFERENCE TO PRIOR APPLICATIONS

This application is the U.S. National Phase application under 35 U.S.C. §371 of International Application No. PCT/IB13/058596, filed on Sep. 17, 2013, which claims the benefit of International Application No. PCT/CN2012/081550 filed on Sep. 18, 2012. These applications are hereby incorporated by reference herein.

FIELD OF THE INVENTION

The invention relates to a lamp comprising a driver assembly, the driver assembly comprising a driver board with driver electronics, at least one point light source and a heat sink, the heat sink comprising a top side and a bottom side, a central space extending from said bottom side to said top side and adapted for receiving said driver board of said driver assembly, and a zone provided at said top side and adapted for receiving said at least one point light source.

BACKGROUND OF THE INVENTION

Lamps of the above type are traditionally halogen light source based and used in halogen spots. These traditional halogen light source based lamps are now to a rising extend being exchanged with LED based lamps of the above type used as retrofits for halogen lighting devices.

Therefore, the demand for an energy saving alternative to existing types of LED-based lamps is very high. Removing the considerable heat generated by the light source is a challenge, which normally necessitates limiting the power, and thus the light output, to levels below what is desired, the use of a heatsink having a size exceeding the outline of the lamp or the inclusion of a fan for active cooling.

Most LED based lamps share the same layout: a central cylindrical body surrounded by a metallic structure with fins working as a heatsink.

The cylindrical body, which usually has a diameter of less than 50 mm, contains the light sources, the optics and the driver assembly. Depending on the driver topology, LED type and number, and optics, the diameter of the cylindrical body may be very large, leaving very little space for the cooling fins.

U.S. Pat. No. 8,018,136 B2 describes an LED connector assembly comprising an LED, a driver assembly and a heat sink having a cylindrical core aperture. The driver assembly comprises a driver card mounted in guide slots extending on opposite sides of the core aperture and configured to receive the driver card. The driver card comprises slots mating with end walls of the guide slots. The electronical components of the driver assembly are arranged on the driver card such as to be positioned within the core aperture.

These known types of lamps have several disadvantages. First of all the thermal resistance (Rth) of the heatsinks is too high to fulfill the requirements for high power applications. The large circular cross section of the central aperture of the known solutions reduces the volume available for the heat dissipating fins of the heat sink resulting in an insufficient air flow. This has been targeted as the main reason for the insufficient thermal resistance of the known lamps. Moreover, the position of the driver assembly results in a rather long thermal path from the components to the heatsink, leading to an elevated average temperature of the driver assembly components being about 7° C. above the temperature of the outskirts of the heat sink.

Furthermore, the space available for the driver assembly is insufficient. The driver requirements in terms of volume and area for the printed circuit board (PCB) of the driver assembly are stringent and hard to achieve within the form factors of the known types of lamps.

Also, while the thermal rating, i.e. the temperature for which they are rated to be able to work without being negatively affected, of most of the components both of the driver assembly and related to the light source is above 125° C., some of them, such as electrolytic capacitor(s), are more sensitive to high temperatures. Therefore, the more thermally sensitive components need to be arranged such as to be better protected from high temperatures. However, the construction of the known types of lamps results in an unsuitable arrangement of both the driver assembly components and the light source components with respect to their thermal rating, as thermally sensitive and heat generating components are arranged closely together.

SUMMARY OF THE INVENTION

It is an object of the present invention to overcome these problems, and to provide a lamp of the type mentioned initially with which the thermal resistance is improved, the amount of space available for the driver assembly is enlarged and the thermally sensitive electronic components are better protected from high temperatures.

According to the invention, this and other objects are achieved with a lamp of the type mentioned initially wherein a plurality of fins adapted for dissipating heat are extending on opposite sides of the central space, and an extension of the central space in at least one radial direction of the heat sink is larger than an extension of the zone in the radial direction of the heat sink such that the central space is provided with at least one section arranged offset from and radially adjacent to the zone.

Thereby a lamp is provided with which:

- more space for the fins of the heat sink is provided, thus improving the thermal resistance of the lamp,
- the amount of space available for the driver assembly is enlarged by means of the extension of the central space in a radial direction thus providing space for arranging the thermally sensitive and heat generating components spaced more apart, and
- a volume with a generally lower temperature is provided for in virtue of the extension of the central space in a radial direction being offset from the zone for receiving the light source, thus providing for better protection of the thermally sensitive components.

In an embodiment the at least one section is arranged such as to constitute a cold spot of the central space, thus providing for a particularly convenient possibility for arranging the electronic components of the driver assembly according to their thermal rating, thereby ensuring even better protection of the thermally sensitive electronic components from high temperatures. Consequently, in an embodiment the driver electronics of the driver board are arranged on the driver board in such a way that in the assembled state of the lamp the components of the driver electronics having the highest thermal sensitivity are placed in the at least one section of the heat sink.

In an embodiment the lamp furthermore comprises an optical component arranged in front of the at least one light source, the optical component comprising optical elements such as a reflector or a collimator, the zone comprising a shape conforming to the shape of the optical component. Thereby it is ensured that the lamp irradiates light with a desired light distribution depending on the types and numbers of optical elements provided for.

In an embodiment the fins of the heat sink are arranged extending from the central space in an asymmetrical manner with respect to a longitudinal direction x of the lamp, whereby a particularly good cooling effect is obtained in that the area of the heat dissipating fins may be made particularly large.

In an embodiment the lamp further comprises at least two point light sources arranged mutually spaced apart, and an optical component is arranged in front of each of the at least two light sources, each of the optical components comprising optical elements such as a reflector or a collimator, the zone comprising a shape conforming to the combined shape of the optical components. Thereby a lamp is provided with which a larger light output may be obtained.

In an embodiment the optical components are arranged in an at least partially overlapping manner, whereby the area necessary for the zone is made smaller, thus providing for an even better cooling effect in that the space available for the fins is increased.

In an embodiment the point light sources are mounted in an array having a linear, a clover-like, a rhombic, a rectangular or a quadratic configuration, thus providing for another parameter for adjusting the light output.

In an embodiment a capacitor and/or a driving element of the driver electronics is placed in the at least one section of the heat sink, thereby protecting the most temperature sensitive components of the driver assembly the most from the heat generated by the light sources in particular.

In an alternative embodiment the at least one section is provided centrally on the central space, the point light sources being arranged around the at least one section in a symmetric or asymmetric manner, whereby the same advantages as described with respect to the first embodiment of the invention are obtained.

The at least one point light source may be arranged on a board.

In an embodiment the board comprises a hole, the components of the driver electronics being placed in the at least one section of the heat sink in the assembled state of the lamp being arranged such as to protrude at least partially through the hole, whereby a particularly efficient cooling of the most heat sensitive components of the driver assembly is achieved.

In an embodiment the driver assembly comprises a driver slot adapted for receiving the driver board, and wherein the central space is adapted for receiving the driver board and the driver slot. Thereby a lamp is provided in which the driver assembly may be mounted in a particularly simple and secure manner, particularly as the driver slot provides for a possibility for arranging the driver assembly and the heat sink electrically isolated from one another.

Preferably, the least one point light source is at least one light emitting diode (LED) or an array of LEDs.

In an embodiment the bottom side of the heat sink is made out of a thermally conductive plastics material and the top side of the heat sink is made out of a metal. Thereby a lamp is provided in which the electrical safety is improved in that the part of the heat sink being the closest to the electrical connector is made of an electrically non-conductive material.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

In the drawings.

DETAILED DESCRIPTION

Figure 1:
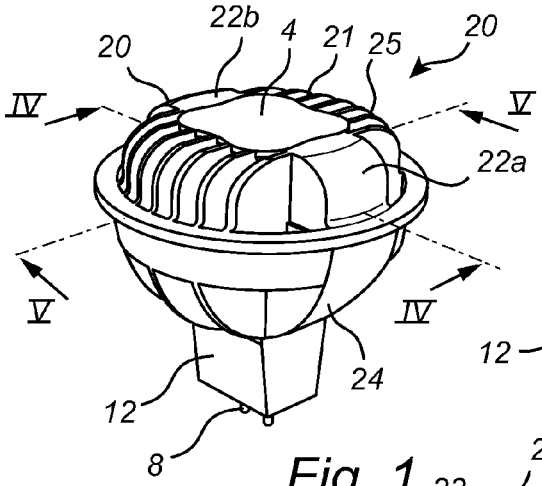
FIG. 1 shows a perspective side view of a first embodiment of a lamp according to the invention.
Figure 2:
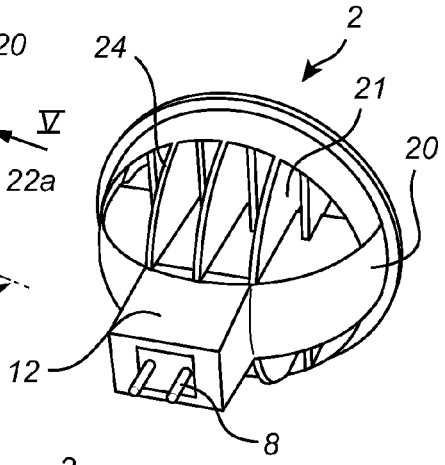
FIG. 2 shows a perspective bottom view of the lamp according to FIG. 1.
Figure 3:
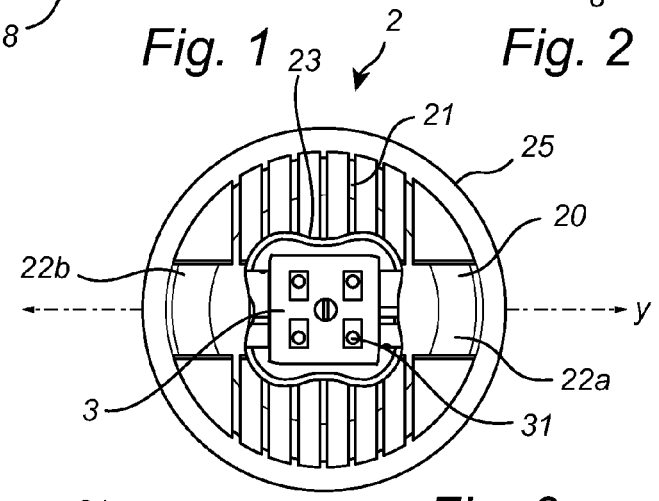
FIG. 3 shows a top view of the lamp according to FIG. 1.
Figure 4:
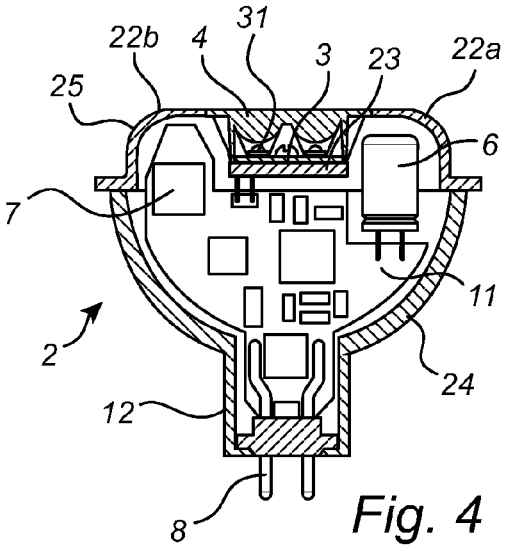
FIG. 4 shows a cross sectional view of the lamp according to FIG. 1 along the line IV-IV of FIG. 1.
Figure 5:
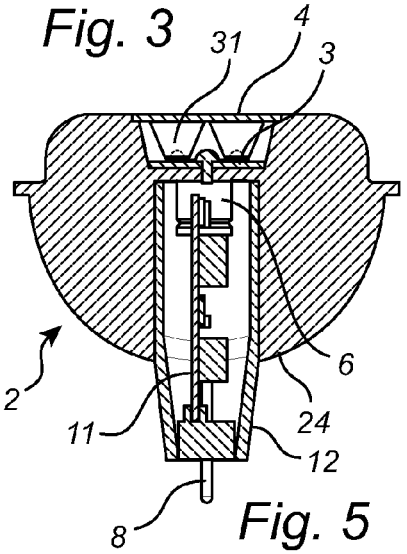
FIG. 5 shows a cross sectional view of the lamp according to FIG. 1 along the line V-V of FIG. 1

FIGS. 1-6 show a first embodiment of a lamp according to the invention. The lamp generally comprises a driver assembly 1, four separately arranged point light sources 31 and a heat sink 2.

The lamp according to FIGS. 1-6 furthermore comprises an optical component 4, a board 3 on which the four point light sources 31 are arranged and a driver slot 12. It is noted that one or more or even all of the optical component 4, the board 3 and the driver slot 12 may be optional.

The driver assembly comprises a driver board 11 with driver electronics for driving the four point light sources. The driver electronics includes a driving element 7 and a capacitor 6 as well as other electronic components necessary for driving the four point light sources in a way known per se by the skilled person. It is noted that the driving element 7 and the capacitor 6 are the two most heat sensitive components of the driver electronics. The driver electronics preferably also comprises at least one electrical connection element 8, such as a pin, for connection to a source of electrical energy for providing electrical energy to the lamp.

The at least one point light source 31—i.e. in FIGS. 1-6 the four point light sources—may in principle be any feasible type of point light source, such as e.g. a light source with a pin hole arranged in front thereof, or an array of point light sources. Alternatively, a linear light source, such as e.g. a linear Chip-On-Board LED, may be used. In the embodiments shown in the drawings the at least one point light source 31 is, however, a light emitting diode (LED), but may also be two or more LEDs or an array of LEDs. The number of point light sources 31 may furthermore in principle be any feasible or desirable number.

The optical component 4 shown in FIGS. 1-6 in fact consists of four separate optical components, one for each point light source 31, which are provided in a clover-like and partially overlapping configuration such as to provide for optical components taking up as little space as possible. The optical component 4 comprises optical elements which may in principle be any type of optical elements. For instance the optical element may be a reflector, a lens, a mirror, a grating, a prism, a diffuser or a combination thereof.

The heat sink 2 comprises a top side 25 and a bottom side 24. A central space 20 extends in the longitudinal direction x (FIG. 6) of the heat sink 2 from the bottom side 24 to the top side 25 and is adapted for receiving the driver board 11 and the driver slot 12 of the driver assembly. In embodiments where the driver slot 12 is omitted the central space is merely adapted for receiving the driver board 11. A zone 23 is provided at the top side 25 for receiving the at least one point light source 31, the board 3 and the optical component 4. In embodiments where the board 3 and/or the optical component 4 is omitted the zone is merely adapted for receiving those of the at least one point light source 31, the board 3 and the optical component 4 present.

Figure 6:
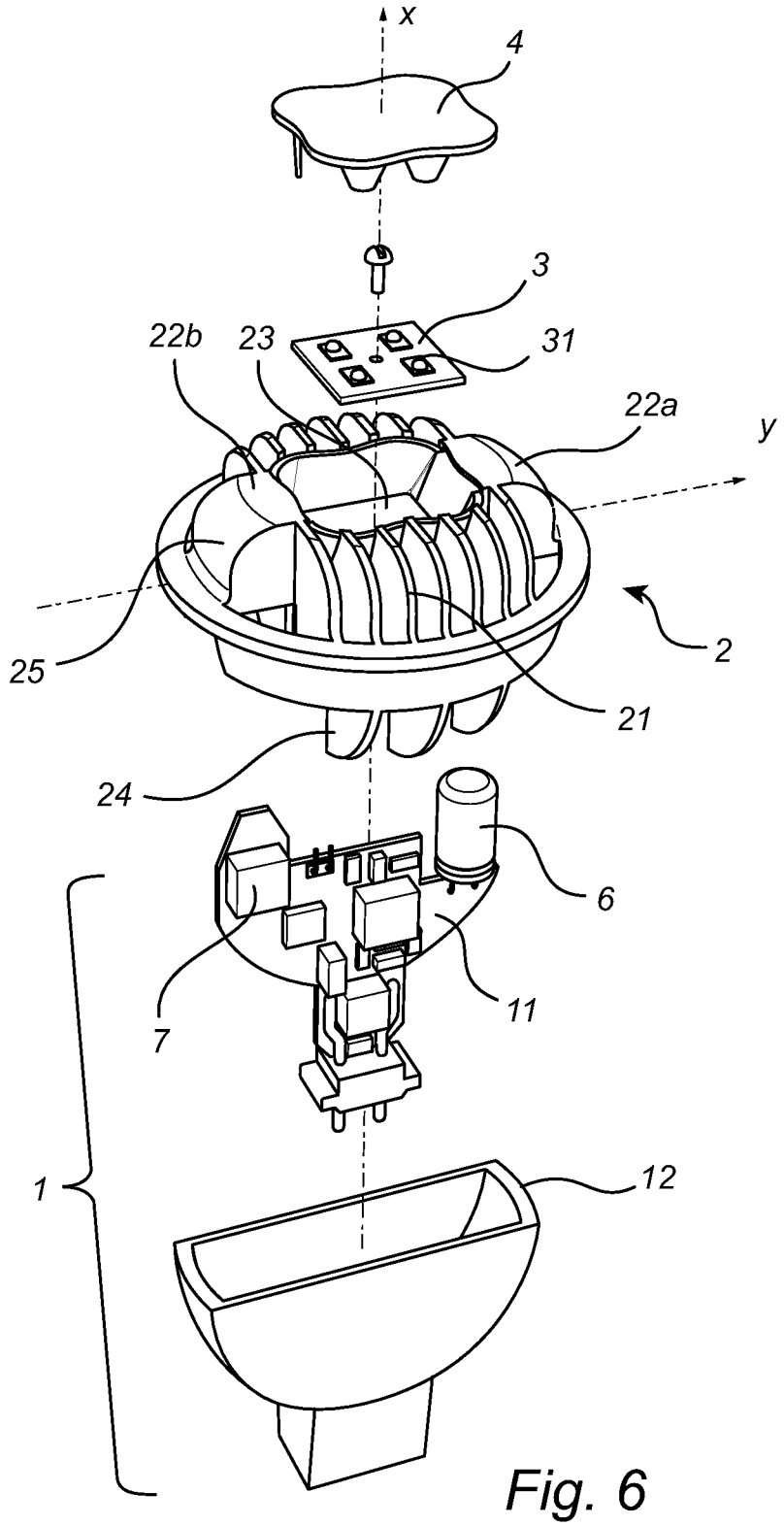
FIG. 6 shows an exploded view of the lamp according to FIG. 1.

The heat sink furthermore comprises a plurality of fins 21 adapted for dissipating heat. The fins 21 are extending on opposite sides of the central space 20 seen in the radial direction y of the heat sink 2 (FIG. 6). Preferably, the fins 21 extend from the opposite sides of the central space 20 in an asymmetrical manner, particularly in an asymmetrical manner with respect to the longitudinal direction x of the lamp.

The central space 20 comprises an extension in at least one radial direction y of the heat sink 2 being larger than an extension of the zone 23 in the same radial direction of the heat sink 2. Thereby the central space 20 is provided with at least one section 22 arranged offset from and radially adjacent to the zone 23. In the embodiment shown in FIGS. 1-6 the central space is provided with two such sections 22*a*, 22*b*. Preferably, the two sections 22*a*, 22*b* are arranged such as to constitute cold spots of the central space 20.

The heat sink 2 is preferably made of a metal, such as e.g. aluminum, for good heat dissipation properties. In a preferred embodiment, however, the bottom side 24 of the heat sink 2 is made out of a thermally conductive plastics material and the top side 25 of the heat sink 2 is made out of a metal, e.g. aluminium.

The board 3 is preferably a printed circuit board (PCB) but may in principle be any suitable type of board. The board 3, on which the four point light sources 31 are mounted, is arranged in the zone 23 and attached to the heat sink 2 in such a way that the four point light sources 31 are electrically connected to the driver assembly 1. The optical component 4 is arranged on top of the four light sources.

The driver board 11 is preferably a printed circuit board (PCB) but may in principle be any type of board suitable for mounting electronic components in a circuit. The driver board 11 of the driver assembly 1 is arranged in the driver slot 12, which in turn is arranged in the central space 20. The electronic components of the driver board 11 are arranged in such a way on the driver board, that when the lamp is assembled, the electronic components which are the most temperature sensitive—i.e. the driving element 7 and the capacitor 6—are arranged each in one of the two sections 22*a*, 22*b* of the central space 20 of the heat sink 2. As the two sections 22*a*, 22*b* are arranged offset from and radially adjacent to the zone 23, the sections 22*a*, 22*b* are not directly exposed to the heat irradiation from the point light sources 31, and therefore provide volumes with a lower temperature than the part of the central space 20 directly below the point light sources 31. Also, the capacitor 6 and the driving element 7 are arranged in a distance from the remaining components of the driver board 11 as well as from the point light sources 31.

It is noted that a luminaire comprising a lamp according to the invention may furthermore comprise at least one housing (not shown) enclosing the lamp at least partially. In a particular embodiment, however, the heat sink 2 may form the housing.

Figure 7:
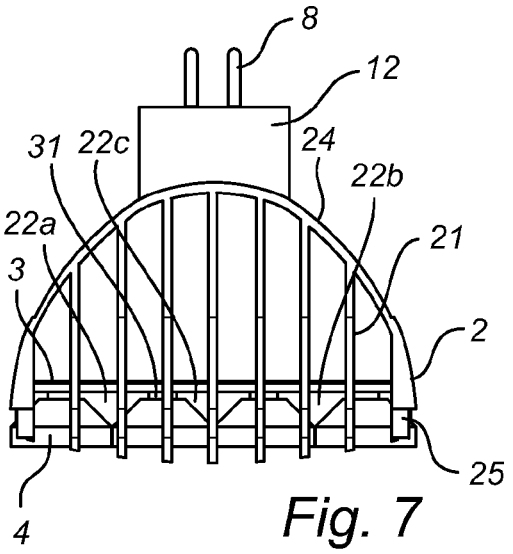
FIG. 7 shows a cross sectional view of a second embodiment of a lamp according to the invention along the longitudinal axis x shown in FIG. 9.
Figure 8:
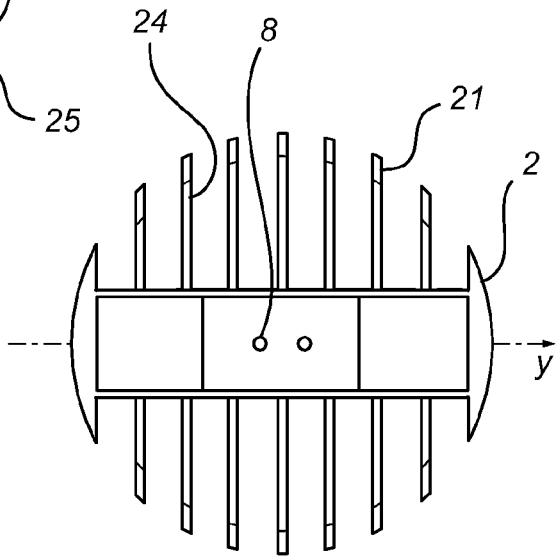
FIG. 8 shows a bottom view of the lamp according to FIG. 7.
Figure 9:
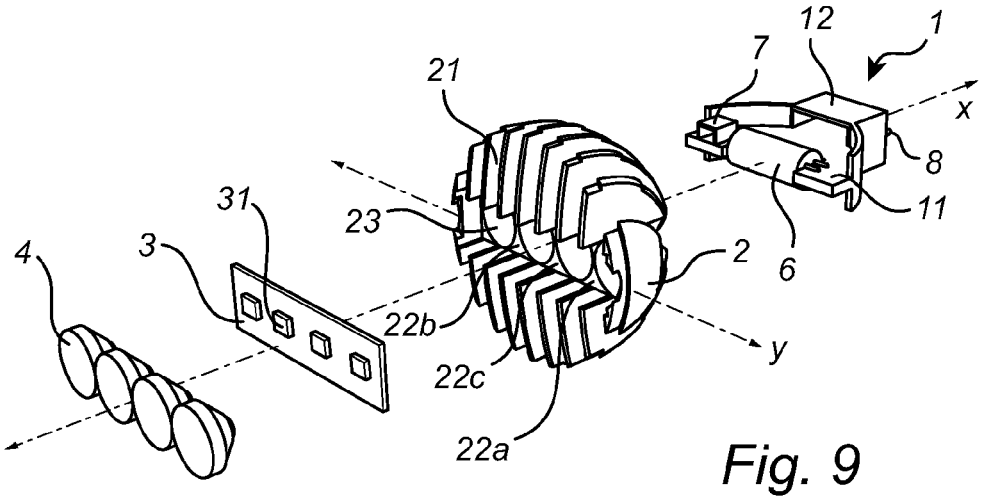
FIG. 9 shows an exploded view of the lamp according to FIG. 7.

Turning now to FIGS. 7-9 a second embodiment of a lamp according to the invention is shown. The lamp according to FIGS. 7-9 differs from the lamp described above with respect to FIGS. 1-6 only in the configuration of the point light sources 31 and in the configuration of the sections 22*a*, 22*b* and 22*c*.

The lamp according to FIGS. 7-9 comprises four point light sources 31 arranged mutually spaced apart on a common board 3. The four point light sources 31 are arranged in a linear array extending in a radial direction y of the heat sink 2. In principle the four point light sources 31 may just as well be arranged on four separate boards, one for each point light source. An optical component 4 of the type described above is arranged in front of each of the four point light sources 31. Each optical component 4 comprises a circular cross section.

The zone 23 of the heat sink 2 comprises a shape conforming to the combined shape of said optical components 4, i.e. a shape corresponding to four circular areas arranged on a line such as to be spaced apart or to touch each other in one peripheral point (cf. FIG. 9). Hence the central space 20 comprises three sections 22*a*, 22*b*, 22*c* arranged offset from and radially adjacent to the zone 23 in positions corresponding to the transition between the four circular areas of the zone 23. As may be seen from FIG. 9, the driving element 7 and the capacitor 6 are arranged on the driver board 11 in such a way to be placed in section 22*b* and 22*c*, respectively, in the assembled state of the lamp.

In this way the part of the lamp consisting of the driver assembly 1, the point light sources 31 including board 3 and the optical components 4 becomes very compact, thereby leaving more room for the heat dissipating fins 21 extending on each opposite side of the central space 20.

It is noted that irrespective of the embodiment the point light sources 31 of the lamp may in principle be mounted in an array having any feasible geometrical configuration. Examples are, without being limited to, a linear, a clover-like, a rhombic, a rectangular or a quadratic configuration. Furthermore, the optical components 4 may be arranged in an overlapping or a non-overlapping configuration.

Different examples are shown in FIGS. 11 and 14-17. The lamp shown in FIG. 11 comprises four point light sources (not visible) arranged in a quadratic configuration and with four optical components 4 arranged in an overlapping configuration. FIGS. 14-17 show a lamp according to the embodiment described above and shown in FIGS. 1-6 but in which the four point light sources 31 are provided in a rhombic configuration with optical components 4 arranged in an overlapping configuration.

Figure 10:
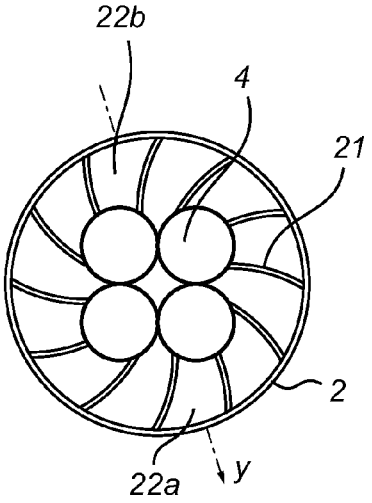
FIG. 10 shows a top view of a lamp according to the first embodiment of the invention and with an alternative configuration of the fins of the heat sink.
Figure 11:
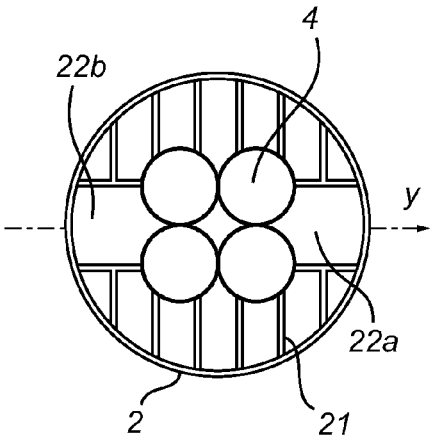
FIG. 11 shows a different embodiment of the central space and the zone of the heat sink of a lamp according to the first embodiment of the invention comprising several light sources with mutually overlapping optical elements.

Also, the fins 21 of the heat sink 20 may be provided with other shapes than the linear shape shown in the embodiments of FIGS. 1-9. FIG. 10 shows a lamp provided with a heat sink 2 comprising a plurality of fins 21 arranged in a swirling configuration. With such a heat sink 2 the central space 20 and the zone 23 of the heat sink 2 may, and as shown in FIG. 10, be provided with a cross section having an S-like shape or a shape conforming to the space between two sets of radially opposing fins.

Figure 18:
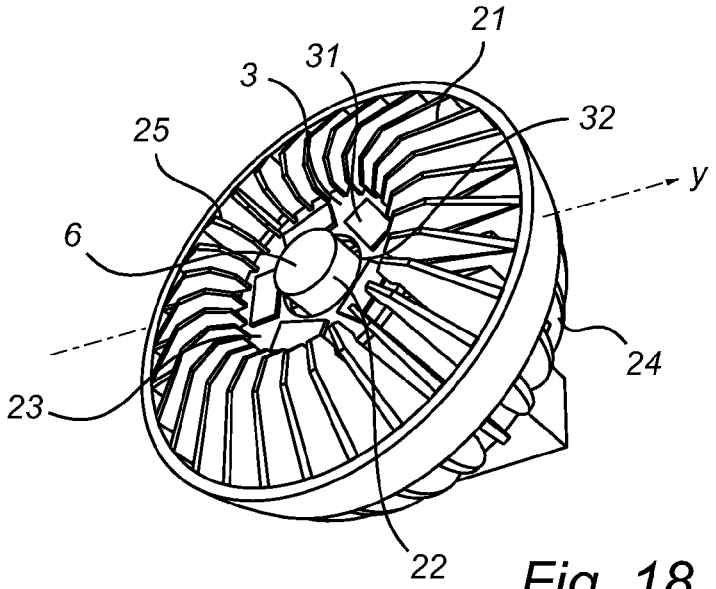
FIG. 18 shows a perspective top view of a third embodiment of a lamp according to the invention.
Figure 19:
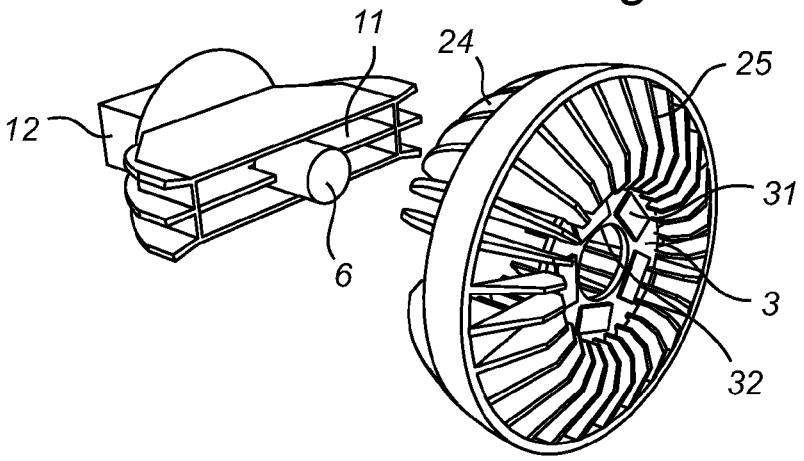
FIG. 19 shows a perspective view of a heat sink and of a driver slot with a driver assembly of a lamp according to FIG. 18.
Figure 20:
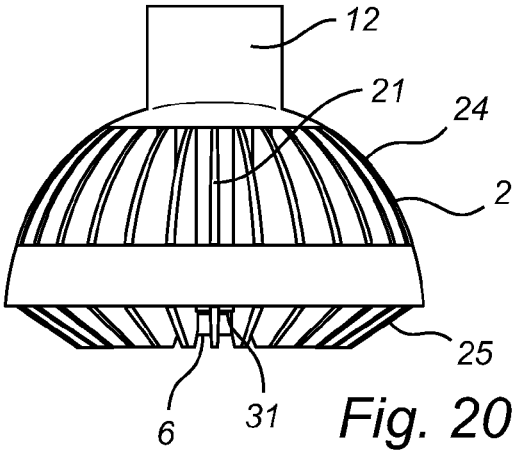
FIG. 20 shows a perspective side view of a lamp according to FIG. 18.

Turning now to FIGS. 18-20 a third embodiment of a lamp according to the invention is shown. The lamp according to FIGS. 18-20 differs from the lamp according to the first embodiment described above with respect to FIGS. 1-6 only in the aspects described in the following.

The lamp shown in FIGS. 18-20 comprises five point light sources 31 arranged on a board 3 in a circular configuration on the zone 23 of the central space 20 of the heat sink 2 around a central area of the board 3 on which no point light source is provided. Hence, the zone 23 in this embodiment has a ring-shaped configuration. This central area of the board 3 is arranged over the section 22, which is arranged offset from and radially adjacent to the zone 23, of the central space 20.

The central area of the board 3 is in the embodiment shown provided with a hole 32, through which the capacitor 6 is arranged to extend. Alternatively another heat sensitive element of the driver electronics may be arranged to extend through the hole 32. Alternatively, in embodiments with no hole in the board 3, the capacitor 6 may be arranged directly under the central area of the board 3.

Furthermore, the plurality of fins 21 are arranged extending radially from all sides, and thus also opposite sides, of the central space 20 of the heat sink 2 as the radial extension of the central space 20 is smaller than the radial extension of the heat sink 2 itself.

Figure 12:
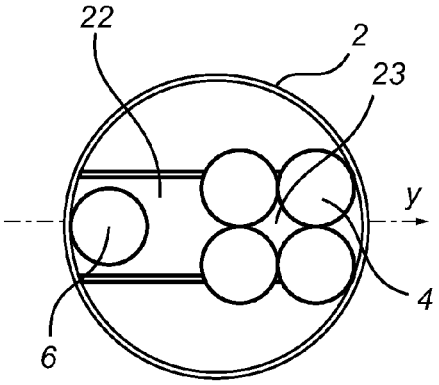
FIGS. 12-13 show two different embodiments of the central space and the zone of the heat sink of a lamp according to the invention comprising several light sources with optical elements, the zone being arranged eccentrically with respect to the center of the heat sink.
Figure 13:
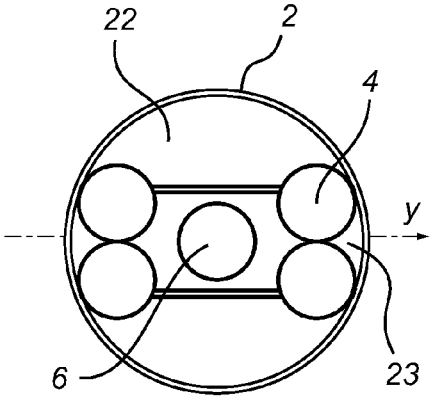
Figure 14:
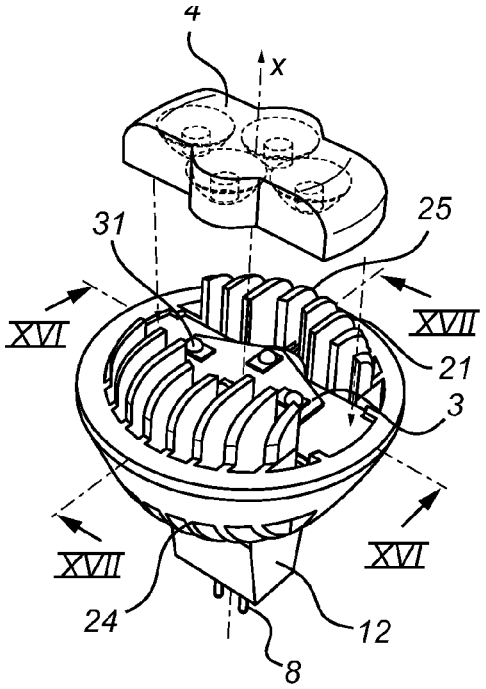
FIG. 14 shows a perspective side view of a lamp according to the first embodiment of the invention in which four point light sources are provided in a rhombic configuration with overlapping optical components.
Figure 15:
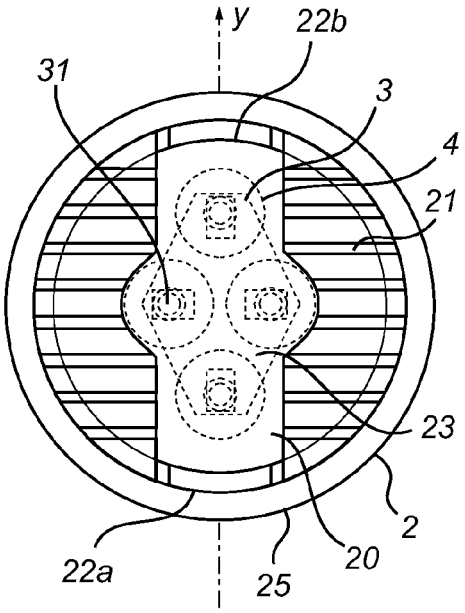
FIG. 15 shows a top view of the lamp according to FIG. 14.
Figure 16:
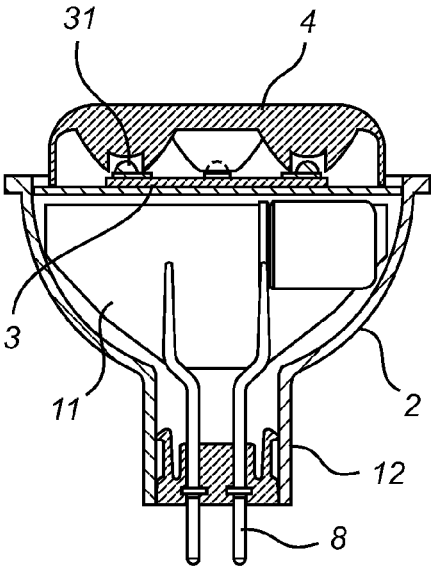
FIG. 16 shows a cross sectional view of the lamp according to FIG. 14 along the line XVI-XVI shown in FIG. 14.
Figure 17:
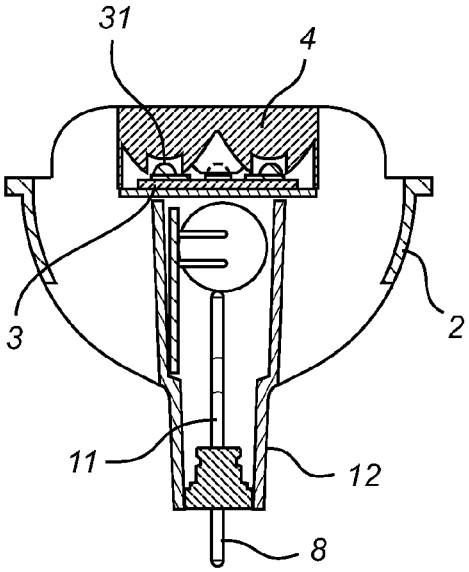
FIG. 17 shows a cross sectional view of the lamp according to FIG. 14 along the line XVII-XVII shown in FIG. 14.

FIGS. 12-13 show two different configurations of the section 22 and the zone 23 of the central space 20 of the heat sink 2 of a lamp according to the third embodiment of the invention. In both configurations, the lamps comprise four point light sources (not visible) with associated optical components 4 arranged eccentrically on the central space and radially offset from the center of the heat sink. Hence, the zone 23 of the heat sink is likewise arranged eccentrically on the central space and radially offset from the center of the heat sink FIG. 12 shows a configuration in which the zone 23 and thus all four point light sources (not visible) and associated optical components 4 are arranged radially offset to the same side of the center of the heat sink 2 and in which the section 22 is arranged radially offset to the opposite side. As shown, the capacitor 6 of the driver electronics is arranged in the section 22.

FIG. 13 shows a configuration with four point light sources (not visible) and associated optical components 4 arranged in two groups with two point light sources each. Two of the point light sources and associated optical components 4 are radially offset to one side of the center of the heat sink 2 and two of the point light and associated optical components 4 sources are radially offset to the opposite side. The zone 23 is thus divided into two radially opposite areas corresponding to each of the two groups of point light sources. The section 22 is arranged centrally on the heat sink 2 and thus on the central space 20. As shown, the capacitor 6 of the driver electronics is arranged in the section 22.

Figure 21:
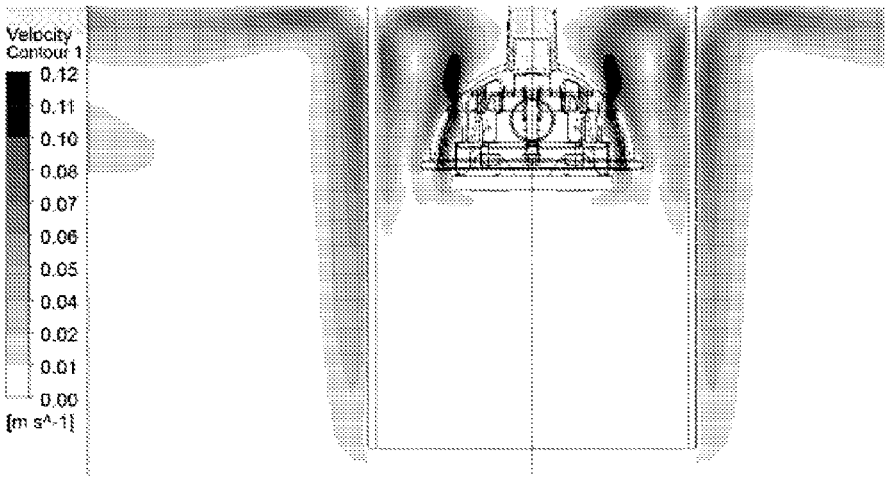
FIG. 21 shows a graphical representation of a simulation of the velocity of the air flow through the heat sink of a conventional prior art lamp.
Figure 22:
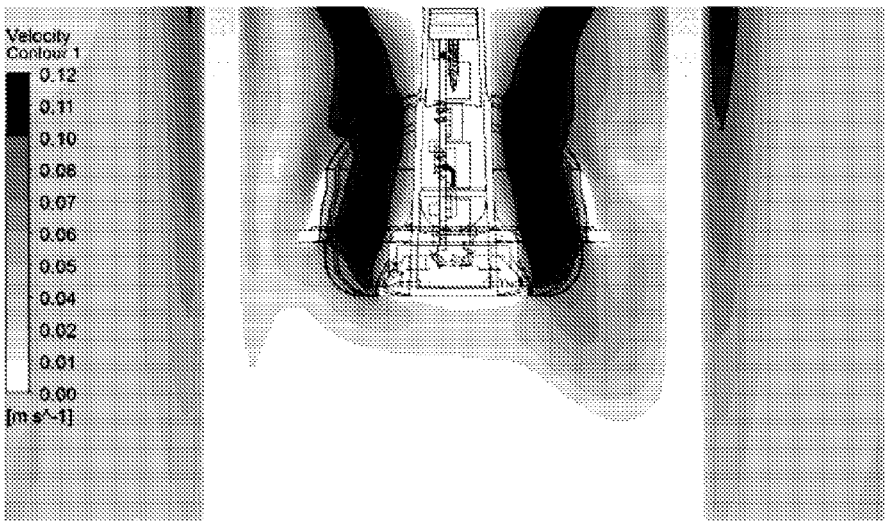
FIG. 22 shows a graphical representation of a simulation of the velocity of the air flow through the heat sink of a lamp according to the invention.

Finally, turning to FIGS. 21 and 22 an illustration of the effect on the velocity of the air flow, and thus the heat dissipation, through a heat sink of a lamp according to the invention is shown.

FIG. 21 represents a simulation of the velocity of the air flow through the heat sink of a conventional prior art lamp, while FIG. 22 shows a simulation of the velocity of the air flow through the heat sink of a lamp according to the invention. Both simulations are made by means of Computational Fluid Dynamics (CFD) simulation, showing the air flow, as it results from a natural convection case, where the heat sink temperature is kept the same in both cases. Also, the lamps were provided with an identical number of point light sources and the ambient temperature as well as the voltage and frequency applied to the lamps was the same in the two simulations.

As is apparent from the simulations the velocity, and thus the heat transfer coefficient, is increased considerably with lamps according to the invention, as shown in FIG. 22. Measurements also show an improvement in thermal resistance between the prior art type lamps and a lamp according to the invention of more than 20% from 10.5 to 8.5 K/W.

The person skilled in the art realizes that the present invention by no means is limited to the preferred embodiments described above. On the contrary, many modifications and variations are possible within the scope of the appended claims.

The invention claimed is:

1. A lamp comprising a driver assembly, said driver assembly comprising a driver board with driver electronics, at least one point light source and a heat sink, the heat sink comprising:

a top side and a bottom side, a central space extending from said bottom side to said top side in a longitudinal direction of said lamp, said central space configured to receive said driver board of said driver assembly, said central space being substantially U-shaped in the longitudinal direction and having first and second sections provided at said top side, a zone provided at said top side and configured to receive said at least one point light source, wherein said at least one point light source is arranged between said first and second sections of said central space, and a plurality of fins configured for dissipating heat extend on opposite sides of said central space, wherein said driver assembly comprises a driver slot configured to receive said driver board, said driver slot arranged within said central space, and said driver slot having at least one pair of parallel sides, wherein said driver electronics of said driver board are arranged on said driver board in such a way that in the assembled state of the lamp the components of the driver electronics having the highest temperature sensitivity are placed in said first or second section of said central space of the heat sink.

2. The lamp according to claim 1, further comprising an optical component arranged in front of said at least one light source, said optical component comprising optical elements comprising a reflector or a collimator, said zone comprising a shape conforming to the shape of said optical component.

3. The lamp according to claim 1, wherein said fins of said heat sink are arranged extending from said central space in an asymmetrical manner with respect to said longitudinal direction of said lamp.

4. The lamp according to claim 3, wherein said point light sources are mounted in an array having a linear, a clover-like, a rhombic, a rectangular or a quadratic configuration.

5. The lamp according to claim 1, further comprising at least two point light sources arranged mutually spaced apart, and wherein an optical component is arranged in front of each of the said at least two light sources, each said optical component comprising optical elements, said zone comprising a shape conforming to the combined shape of said optical components.

6. The lamp according to claim 5, wherein said optical components are arranged in an at least partially overlapping manner.

7. The lamp according to claim 1, wherein a capacitor and/or a driving element of said driver electronics is placed in said first or second section of the central space of the heat sink.

8. The lamp according to claim 1, wherein said first or second section is provided centrally on said central space, said point light sources being arranged around said at least one section in a symmetric or asymmetric manner.

9. The lamp according to claim 1, wherein said at least one point light source is arranged on a board; wherein said board comprises a hole, said components of the driver electronics being placed in said first or second section of the heat sink in the assembled state of the lamp being arranged to protrude at least partially through said hole.

10. The lamp according to claim 1, wherein said central space is configured to receive said driver board and said driver slot.

11. The lamp according to claim 1, wherein said at least one point light source is at least one light emitting diode or an array of LEDs.

12. The lamp according to claim 1, wherein the bottom side of said heat sink is made out of a thermally conductive plastics material and wherein the top side of said heat sink is made out of a metal.

13. A luminaire comprising a lamp according to claim 1, wherein the luminaire furthermore comprises at least one housing enclosing said lamp at least partially.

* * * * *